US005716281A

United States Patent [19]

Dote

[11] Patent Number: 5,716,281

[45] Date of Patent: Feb. 10, 1998

[54] GAME APPARATUS USING A VEHICLE WITH AN OPTICAL IMAGE SYNTHESIZING SYSTEM

[75] Inventor: Shingo Dote, Tokyo, Japan

[73] Assignee: Sega Enterprises, Ltd., Tokyo, Japan

[21] Appl. No.: 562,939

[22] Filed: Nov. 27, 1995

[51] Int. Cl.[6] ..... A63G 31/16

[52] U.S. Cl. ..... 472/60; 463/2

[58] Field of Search ..... 463/2, 5, 36, 37, 463/34; 434/62, 29; 472/43, 59, 60, 65; 273/148 B; 364/578

[56] References Cited

U.S. PATENT DOCUMENTS

| | | | |
|---|---|---|---|
| Re. 32,662 | 5/1988 | Pennington | 463/34 |
| 5,403,238 | 4/1995 | Baxter et al. | 472/43 |
| 5,556,340 | 9/1996 | Bohn et al. | 472/59 |
| 5,607,308 | 3/1997 | Copperman et al. | 434/62 |

FOREIGN PATENT DOCUMENTS

| | | |
|---|---|---|
| 2-17181 | 2/1990 | Japan . |
| 3-123579 | 5/1991 | Japan . |
| 4-108480 | 4/1992 | Japan . |
| 4-193286 | 7/1992 | Japan . |
| 5-212157 | 8/1993 | Japan . |
| 6-343766 | 12/1994 | Japan . |

*Primary Examiner*—George Manuel

*Attorney, Agent, or Firm*—Dickstein Shapiro Morin & Oshinsky LLP

[57] ABSTRACT

A game apparatus has a vehicle which can display an image matching a background scene of a playing area by synthesizing the image with the background scene. The vehicle moves along a vehicle path provided through the playing area. A player plays a game in the playing area while the player views the background scene of the playing area. An image matching the background scene of the playing area is displayed by a virtual image forming system provided on the vehicle. A scene in which the virtual image is synthesized with the background scene is viewed by the player.

27 Claims, 7 Drawing Sheets

GAME APPARATUS USING A VEHICLE WITH AN OPTICAL IMAGE SYNTHESIZING SYSTEM

BACKGROUND OF THE INVENTION

1. Field of the Invention

The present invention generally relates to game apparatuses, and more particularly to a game apparatus in which a player plays a game while riding a vehicle which moves in a playing area provided with a background scene.

2. Description of Related Art

A conventional game apparatus in which a player plays a game while riding a vehicle which moves in a playing area provided with a background scene is disclosed in Japanese Laid-Open Patent Application No.3-123579. In this game apparatus, a scenario or a sequence of a game play can be changed according to a score of a player playing the game. That is, a plurality of playing modes are provided in the game so as to change the scenario or the sequence of the game play. More specifically, a moving path for the vehicle on which the player rides is changed so that the vehicle moves in different paths according to the score of the player, or the vehicle moves to different playing areas according to the score of the game.

In this conventional game apparatus, there is a problem in that the moving path for the vehicle is complex because a plurality of branch paths must be provided so as to change a scenario of the game. Additionally, there is another problem in that, an entire game apparatus becomes large because many playing areas must be provided in the game apparatus so as to change a scenario of the game, and thus manufacturing cost of the game apparatus is high.

In the above-mentioned patent application, a shooting game is described as an embodiment to which the above-mentioned conventional game apparatus is applied. In this shooting game, a player rides a vehicle and shoots a target such as a monster appearing in a background scene of a playing area by using a beam gun provided on the vehicle. An optical wireless communication system is provided to the game apparatus so as to transmit a result of the shooting to the vehicle so that a score of the shooting is displayed on a display provided on the vehicle.

The above-mentioned shooting game has a problem in that a background set is large-scaled and complex because targets must be actually provided in the playing area. Additionally, there is a problem in that a number of wireless communication devices including a transmitter and a receiver must be provided to the targets as well as a communication device provided on the vehicle, and thus an entire communication system provided in the game apparatus is complex.

SUMMARY OF THE INVENTION

It is a general object of the present invention to provide an improved and useful game apparatus in which the above-mentioned problems are eliminated.

A more specific object of the present invention is to provide a game apparatus having a vehicle which can display an image matching a background scene of a playing area by synthesizing the image and the background scene when a player views the background scene.

Another object of the present invention is to provide a shooting game apparatus having a vehicle which is provided with a gun and moves along a path, the vehicle displaying an image of targets to be shot which image is synthesized with a background scene of each playing area provided along the path.

In order to achieve the above-mentioned objects of the present invention, there is provided according to one aspect of the present invention a game apparatus comprising:

at least one playing area having a background scene;

a vehicle path provided through the playing area; and a vehicle, the vehicle moving along the vehicle path so that at least one player riding on said vehicle plays a game in the playing area while the player views the background scene of the playing area, the vehicle comprising display means for displaying an image matching the background scene of the playing area so that a scene in which the image is synthesized with the background scene is viewed by the player.

There is provided according to another aspect of the present invention a vehicle used in a game apparatus comprising at least one playing area having a background scene and a vehicle path provided through the playing area, the vehicle moving along the vehicle path so that at least one player riding thereon plays a game in the playing area while the player views the background scene of the playing area, the vehicle comprising:

projector for projecting an image matching the background scene of the playing area; and an image synthesizer for synthesizing the image with the background scene when the background scene is viewed through the image synthesizer by the player.

Additionally, there is provided according to another aspect of the present invention a shooting game apparatus comprising:

a plurality of playing areas, each of the playing areas having a background scene;

a vehicle path provided through the playing areas; and a vehicle, the vehicle moving along the vehicle path so that at least one player riding on the vehicle plays a shooting game in each of the playing areas while the player views the background scene of each of the playing areas, the vehicle comprising a display device for displaying an image of a target to be shot which image matches the background scene of each of the playing area so that a scene in which the image is synthesized with the background scene is viewed by the player.

Other objects, features and advantages of the present invention will become more apparent from the following detailed description when read in conjunction with the accompanying drawings.

DETAILED DESCRIPTION OF THE DRAWINGS

A description will now be given, with reference to FIG. 1, of an illustrative embodiment of a game apparatus according to the present invention.

Figure 1:
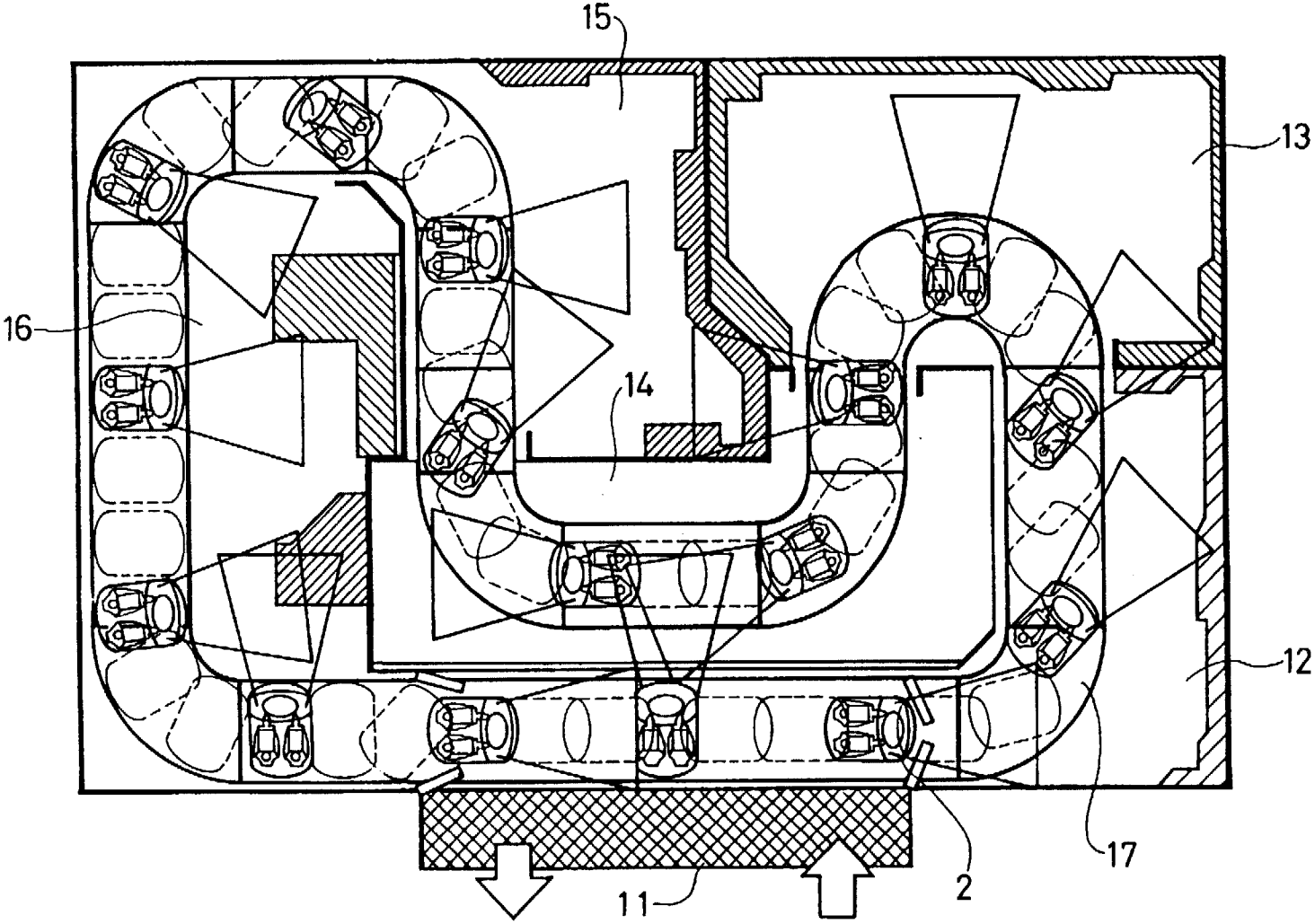
FIG. 1 is an illustration of an embodiment of a shooting game apparatus according to the present invention.

In FIG. 1, the shooting game apparatus 1 comprises a platform 11, a plurality of playing areas 12 to 16, a vehicle path 17 passing through the playing areas 12 to 16 and a plurality of vehicles 2 moving along the path 17. The playing areas 12 to 16 have different background scenes (georamas). For example, the georama of the playing area 12 is an outside view of a mansion, the playing area 13 an interior of a living room, the playing area 14 a dark corridor in the mansion, the playing area 15 an interior of a kitchen and the playing area 16 a basement.

In the shooting game apparatus 1, sixteen vehicles 2 move along the vehicle path 17 forming an endless path while maintaining a predetermined distance to each other so that each of the vehicles 2 passes through, in turn, the playing areas 12 to 16. Each of the vehicles 2 is driven by a driving apparatus (not shown in the figure) provided on the vehicle 2. More specifically, the vehicle 2 has a driving wheel in a center of a bottom thereof. The driving wheel is rotated by a motor (not shown in the figures) so as to move the vehicle 2 along a rail provided in the vehicle path 17.

When one of the vehicles 2 passes a point sensor (not shown in the figure) provided at predetermined positions along the vehicle path 17, a detection signal representing a passage of the vehicle 2 is sent from the point sensor to a vehicle control board (described in detail later) provided on the vehicle 2. The point sensor may take the form of any well known sensor such as a mechanical switch, light/dark sensor, proximity sensor, etc.

Figure 2:
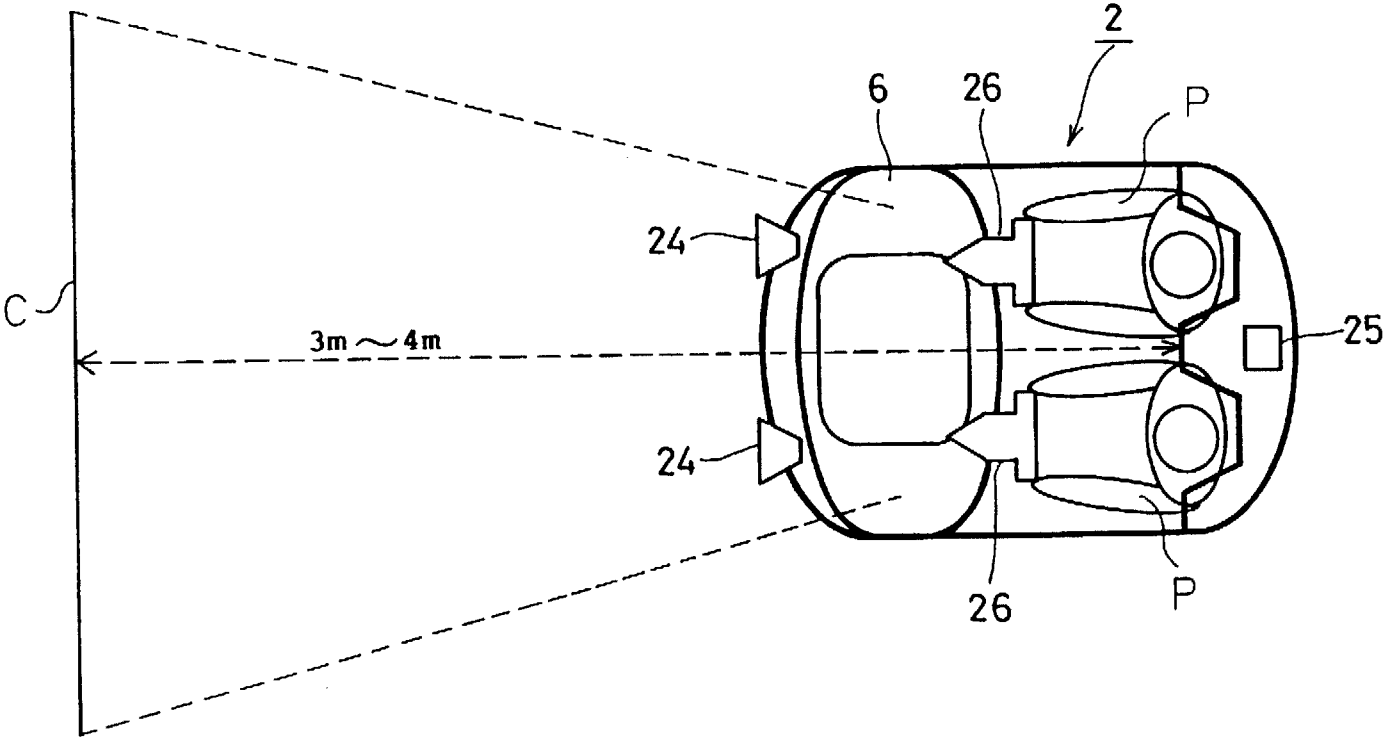
FIG. 2 is a plan view of a vehicle shown in FIG. 1.
Figure 3:
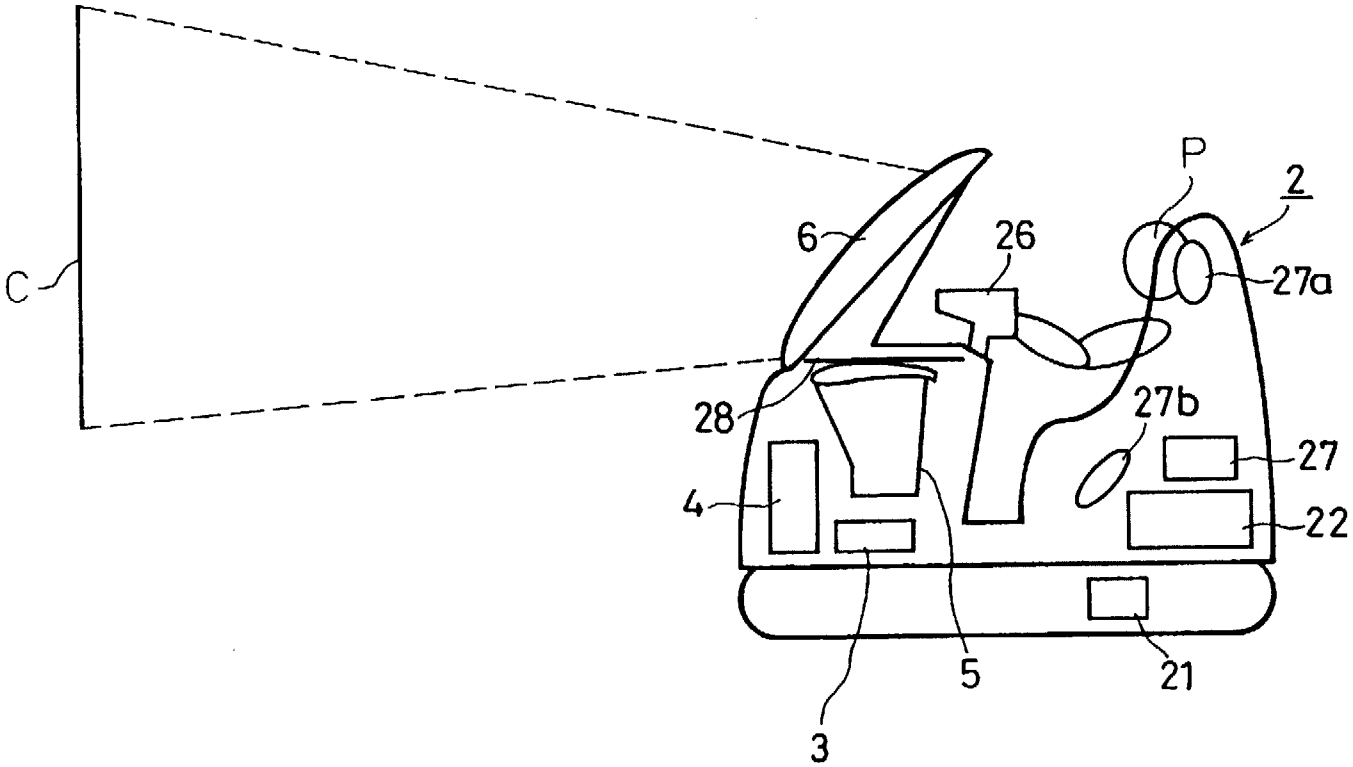
FIG. 3 is a side view of the vehicle shown in FIG. 1.
Figure 4:
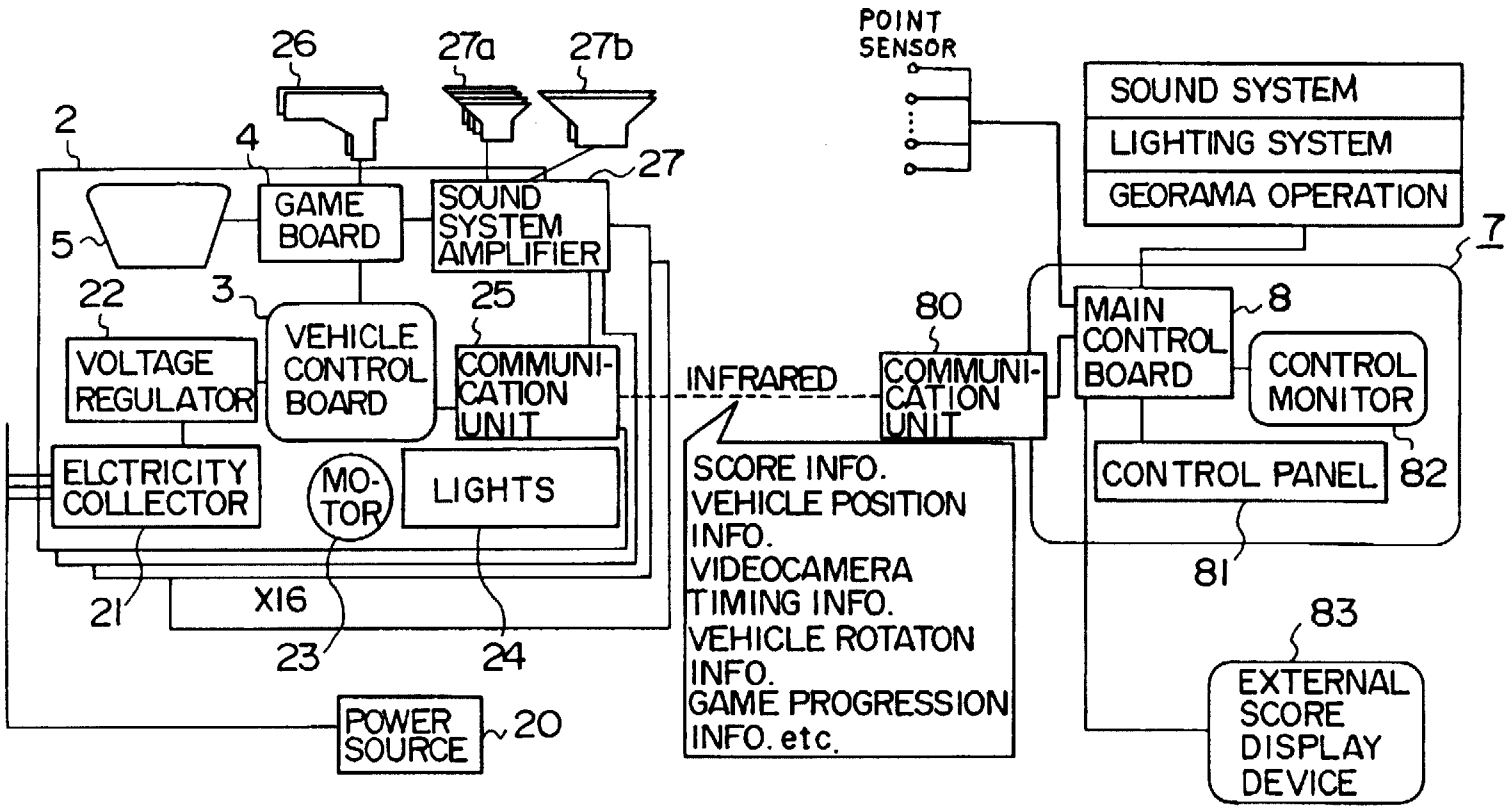
FIG. 4 is a block diagram of an entire shooting game apparatus including the vehicle.

A description will now be given, with reference to FIGS. 2 to 4, of each of the vehicles 2 mentioned above. It should be noted that each of the vehicles 2 has the same construction, and is thus hereinafter simply referred to as a vehicle 2. FIG. 2 is a plan view of the vehicle 2 shown in FIG. 1. FIG. 3 is a side view of the vehicle 2. FIG. 4 is a block diagram of an entire shooting game apparatus a including the vehicle 2.

Referring to FIGS. 2 and 3, the vehicle 2 has two seats so that two players can ride thereon. The vehicle 2 has lights 24, two beam guns 26, a display monitor 5, a slit filter 28, a concave half mirror 6 and a sound system amplifier 27 which drives a speaker 27*a* and a woofer 27*b*.

Additionally, the vehicle 2 has, as electric controlling parts, an electricity collector 21, for example, a voltage regulator 22, a vehicle control board 3, a game board 4, a motor 23 used for rotating the vehicle 2. The electricity collector 21 is connected to an electric power source 20 so as to collect electricity to be supplied to the vehicle 2. The electricity collector 21 corresponds to an electricity supplying system which supplies an electricity to the vehicle 2. For example, the electricity collector 21 comprises a brush which contacts an electric wire provided along the vehicle path 17. The voltage regulator 22 regulates and stabilizes the voltage supplied to the vehicle control board 3 provided in the vehicle 2.

The vehicle control board 3 controls various functions performed in the vehicle 2, such as to control a direction of the vehicle 2 by supplying a control signal to the motor 23, control the lights 24 by supplying a control signal to the lights 24, control communications between a vehicle control board provided on the vehicle 2 and a main control board 8 provided in a control room 7 (not shown in FIG. 1), and control the progress of a game by sending a control signal to the game board 4. It should be noted that the control room 7 is provided adjacent to or in one of the playing areas 12 to 16.

The game board 4 includes a sound circuit and a ROM (not shown in the figures) for making sound effects by using the speaker 27*a* and the woofer 27*b* via the sound system amplifier 27. Additionally, display image information corresponding to each of the playing areas 12 to 16 is stored in the ROM so that an image of target characters matching a georama of one of the playing areas 12 to 16, in which the vehicle 2 is positioned, is displayed on the display monitor 5. That is, when a detection strip provided on a bottom of the vehicle 2 passes an area between adjacent playing areas, a detection signal is output from a passing point sensor provided in each area between adjacent playing areas. The detection signal is sent to the main control board 8, and position information of the vehicle 2 is transmitted to the vehicle control board 3 via the communication units 80 and 25. The position information is then transferred to the game board 4. Target characters, matching the georama of one of the playing areas 12 to 16, are then displayed on the monitor 5. The monitor 5 comprises a 33-inch screen.

Figure 5:
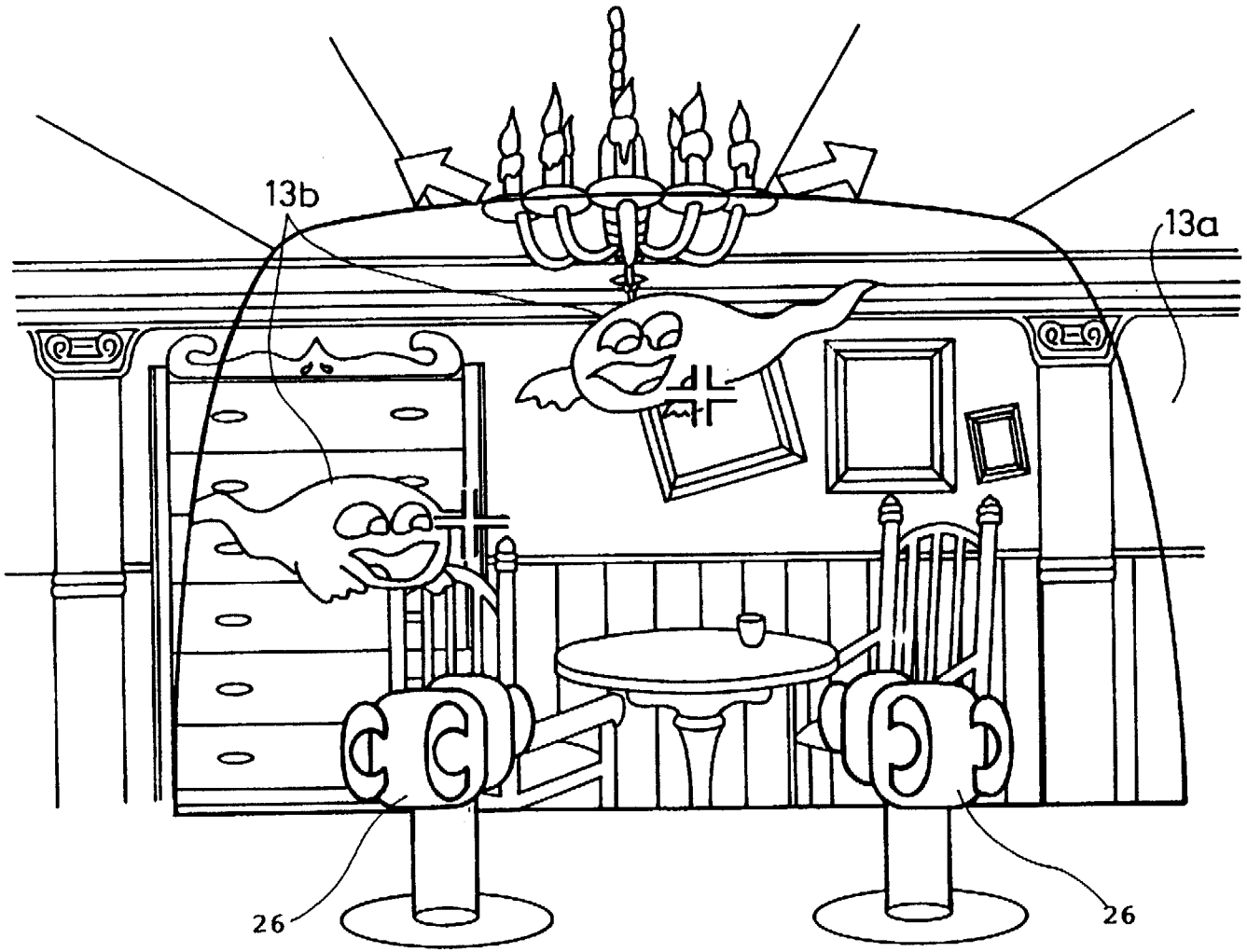
FIG. 5 is a view of one of playing area observed through a half mirror provided on the vehicle shown in FIG. 1.

The slit filter 28 is provided above the display monitor 5 for softening lights from the display monitor 5 observed by the player in the vehicle 2. The half mirror 6, which is provided above the slit filter 28 and is tilted at a predetermined angle, forms a virtual image of the target characters at a position of predetermined distance, approximately 3 to 4 meters, in front of the vehicle 2 so that the virtual image of the target characters is synthesized with the georama viewed in front of the vehicle 2 through the half mirror 6. Accordingly, when viewed from a player P side, a living room georama 13*a* of the playing area 13, for example, is synthesized with target characters, which are ghosts as shown in FIG. 5, so that the ghosts are seen as if they are floating in the living room georama 13*a*. It should be noted that a psychic filter 6*a* (shown in FIG. 6) is provided on the player P side of the half mirror 6 so as to soften the lights from the half mirror 6 observed by the player P in the vehicle 2.

Figure 6:
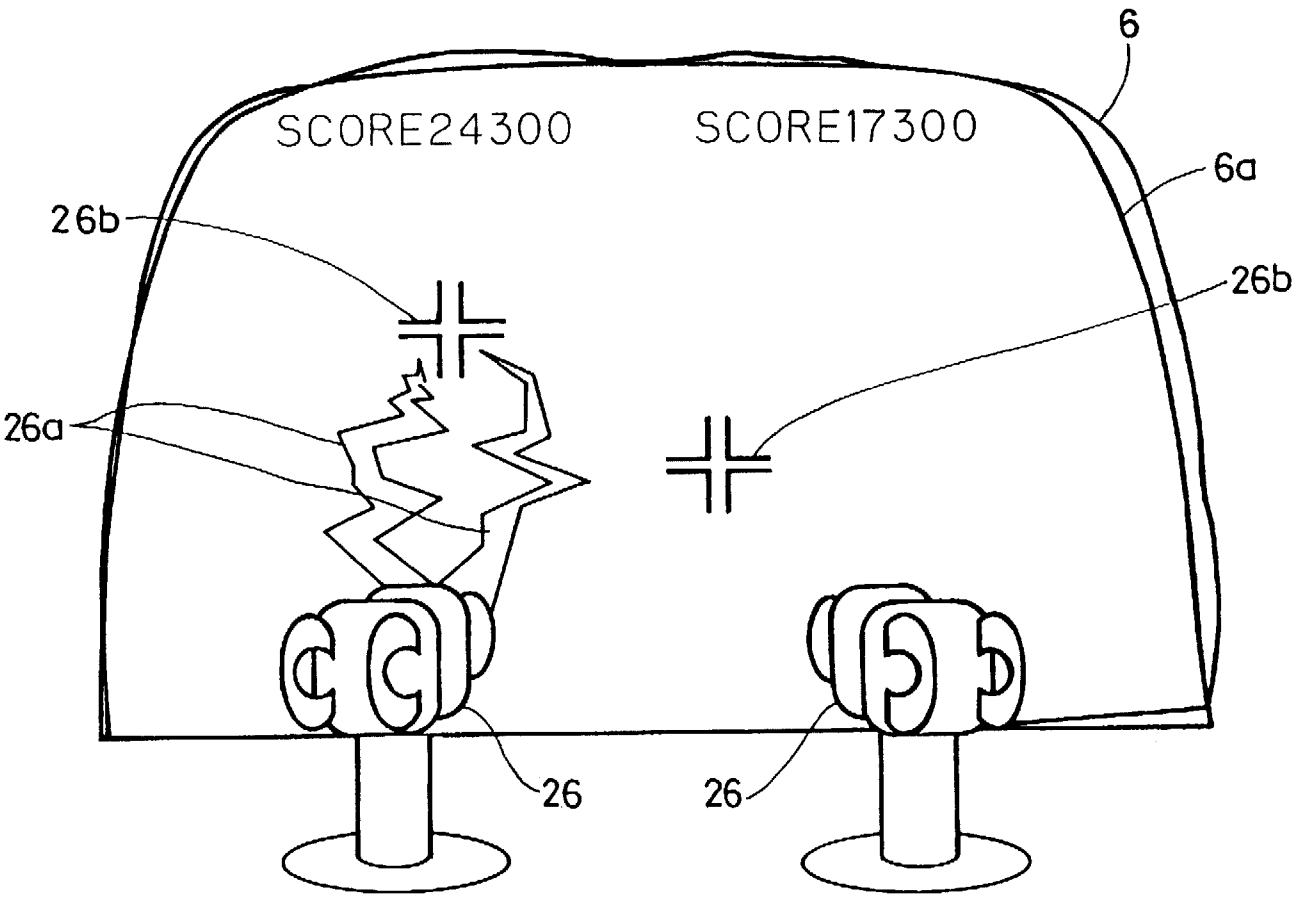
FIG. 6 is a view of the half mirror observed from a player side.

The beam gun 26 simulates an absorption beam gun to absorb the target characters. The target characters formed on the half mirror 6 can be absorbed by aiming the beam gun and matching a sight 26*b* to one of the target characters displayed as shown in FIG. 6. It is determined by the game board 4 whether the target characters are shot by the beam gun 26 in accordance with information as to the direction of the beam gun input to the game board 4. A score corresponding to each of the beam guns, that is each of the players, is displayed on an upper part of the half mirror 6 as shown in FIG. 6.

The communication unit 25 provided on an upper portion of the vehicle 2 communicates with the communication unit 80, as shown in FIG. 4, by means of infrared wireless communication so as to transmit various types of information including score information to a main control board 8 provided in the control room 7.

The main control board 8 sends to the communication unit 80 a control signal including a vehicle rotation command so that the control signal is transmitted to the communication unit 25 of the vehicle 2 by means of an infrared wireless communication. A plurality of communication units 80 are provided on a ceiling of the entire playing areas at a predetermined interval along the vehicle path 17. Accordingly, the vehicle control board 3 of the vehicle 2 can always communicate with the main control board 8 via one of the communication units 80.

Additionally, a control panel 81 and a control monitor 82 are connected to the main control board 8 so as to monitor conditions of the shooting game apparatus 1. Further, a georama operating system, a georama lighting system and a georama sound system (not shown in the figure) are connected to the main control board 8 so that operation of the georama and lighting and sound of each of the playing areas 12 to 16 are controlled by signals supplied by the main control board 8.

Further, an external score display device 83 is connected to the main control board 8 so that a score of the player is displayed on the display device other than that displayed on the half mirror 6 of the vehicle 2.

A description will now be given of an operation of the shooting game apparatus 1 shown in FIG. 1.

Two players enter the vehicle 2 at the platform 11, and the vehicle enters in the playing area 12 first. The point sensor detects the vehicle 2 entering in the playing area 12. The detection signal is sent to the vehicle control board 3 of the vehicle 2 from the point sensor. The vehicle control board 3 sends the signal to the game board 4 according to the detection signal supplied by the vehicle control board 3, and thereby the target characters corresponding to the georama of the playing area 12 are displayed on the display monitor 5.

The target characters displayed on the display monitor 5 are viewed by a player as a virtual image produced by the half mirror 6, and thus the virtual image of the target characters is synthesized with the background georama of the playing area 12 viewed through the half mirror 6. The players then play a shooting game in the playing area 12 by shooting the target characters using the respective beam guns 26 provided on the vehicle 2.

As the vehicle 2 moves to and enters the next playing area 13, the point sensor detects the vehicle 2 entering in the playing area 13, and the detection signal from the point sensor is sent to the vehicle control board 3 of the vehicle 2. The vehicle control board 3 sends the signal to the game board 4 according to the detection signal supplied by the vehicle control board 3, and thereby the target characters corresponding to the georama of the playing area 13, which is different from the target characters in the playing area 12, are displayed on the display monitor 5.

The target characters displayed on the display monitor 5 are viewed by the player as a virtual image produced by the half mirror 6, and thus the virtual image of the target characters is synthesized with the background georama of the playing area 13. The players then play a shooting game in the playing area 13 by shooting the target characters using the respective beam guns 26 provided on the vehicle 2.

Similar operations are performed as the vehicle 2 proceeds to the playing areas 14, 15 and 16, in this order, and finally the vehicle returns to the platform 11. The final score of each of the players is displayed on the external score display device 83 as well as on the upper part of the half mirror 6 on the vehicle 2. It should be noted that when the vehicle 2 is detected by one of the point sensors, the background georama of the corresponding playing area is reset and the georama is displayed again from the beginning.

According to the above-mentioned embodiment, since the target characters are displayed as a virtual image by means of the display monitor 5 and the half mirror 6, and the virtual image is synthesized with the georama of each of the playing areas 12 to 16, no target is physically located in the playing areas, and thus a simple construction of the playing areas of the shooting game apparatus 1 is achieved by eliminating the targets in the playing areas 12 to 16 and communication between the targets and the vehicle as required in the conventional shooting game apparatus.

Figure 7:
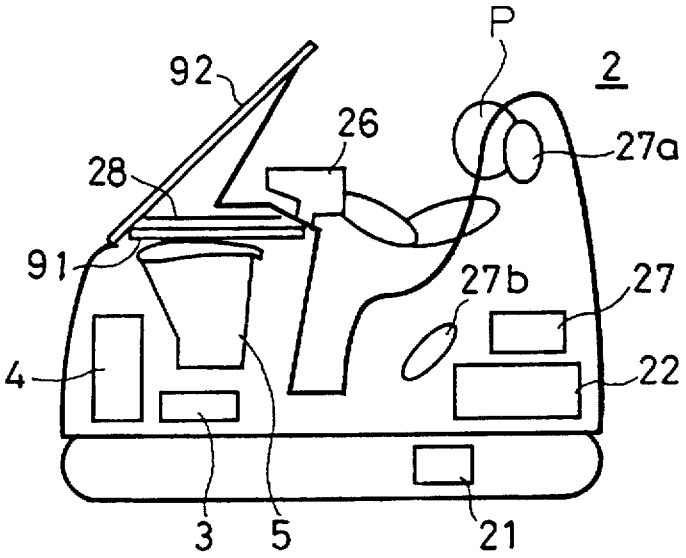
FIG. 7 is a side view of a variation of the vehicle shown in FIG. 1.

It should be noted that the optical system provided in the vehicle 2 is not limited to the concave half mirror 6, and may instead be constituted by a combination of a Fresnel lens 91 positioned above the display monitor 5 and a half mirror 92 tilted a predetermined angle and positioned above the Fresnel lens 91 as shown in FIG. 7.

Additionally, in the above-mentioned embedment, the target characters or the movement of the target characters may be changed according to a result of the game. For example, different target characters can be displayed according to a score of the player by storing information corresponding to different characters in the ROM of the game board 4. By adopting this construction, when the player plays another round of the game due to a high score which score exceeds a predetermined value, shooting conditions in each of the playing areas can be easily changed by changing the target characters or the movement of the target characters even if the vehicle 2 passes through the same playing areas. That is, in the present embodiment, since an image (a first image) displayed in one of the areas can be changed to a different image (a second image) displayed in the same area by a changing means provided on the vehicle side, it is not necessary to provide a branch of the path for the vehicle or to provide additional playing areas so as to change a scenario of the game. Accordingly, a construction of the shooting game apparatus 1 according to the present invention can be further simplified and occupies a space smaller than an area occupied by the conventional shooting game apparatus, and thus manufacturing cost of the shooting game apparatus 1 is further reduced.

The present invention is not limited to the above-mentioned embodiments, and variations and modifications may be made without departing from the scope of the present invention.

What is claimed is:

1. A game apparatus comprising:

at least one playing area having a background scene;

a vehicle path provided through said playing area; and a vehicle, said vehicle moving along said vehicle path so that at least one player riding on said vehicle plays a game in said playing area while the player views said background scene of said playing area, said vehicle comprising a display device for displaying an image in said background scene of said playing area so that a scene in which said image is synthesized with said background scene is viewed by the player.

2. The game apparatus as claimed in claim 1, wherein said display device comprises a display monitor and a virtual image forming system, said display monitor displaying said image, said virtual image forming system synthesizing said image with said background scene when said background scene is viewed through said virtual image forming system.

3. The game apparatus as claimed in claim 2, wherein said virtual image forming system comprises a concave half mirror which forms a virtual image of said image displayed on said display monitor so that said virtual image is synthesized with said background scene.

4. The game apparatus as claimed in claim 3, wherein said virtual image forming system further comprises a filter provided between said concave half mirror and the player so that said filter softens lights viewed by the player.

5. The game apparatus as claimed in claim 2, wherein said virtual image forming system comprises a Fresnel lens and a half mirror which together form a virtual image of said image displayed on said display monitor so that said virtual image is synthesized with said background scene.

6. The game apparatus as claimed in claim 5, wherein said virtual image forming system further comprises a filter provided between said half mirror and the player.

7. The game apparatus as claimed in claim 6, wherein said filter softens light from said projector which are viewed by the player.

8. The game apparatus as claimed in claim 1, wherein said display means further comprises changing means for changing said image from a previously displayed image to other images.

9. A vehicle used in a game apparatus comprising at least one playing area having a background scene and a vehicle path provided through said playing area, said vehicle moving along said vehicle path so that at least one player riding on said vehicle plays a game in said playing area while the player views said background scene of said playing area, said vehicle comprising:

a projector for projecting an image into said background scene of said playing area; and an image synthesizer for synthesizing said image with said background scene when said background scene is viewed through said image synthesizer by a player.

10. The vehicle as claimed in claim 9, wherein said image synthesizer comprises a concave half mirror which forms a virtual image of said image projected by said projector so that said virtual image is synthesized with said background scene.

11. The vehicle as claimed in claim 10, wherein said image synthesizer further comprises a filter provided between said concave half mirror and the player.

12. The game apparatus as claimed in claim 11, wherein said filter softens light from said projector which are viewed by the player.

13. The vehicle as claimed in claim 9, wherein said image synthesizer comprises a Fresnel lens and a half mirror which together form a virtual image of said image projected by said projector so that said virtual image is synthesized with said background scene.

14. The vehicle as claimed in claim 13, wherein said image synthesizer further comprises a filter provided between said half mirror and the player.

15. The game apparatus as claimed in claim 14, wherein said filter softens light from said projector which are viewed by the player.

16. The vehicle as claimed in claim 9, wherein said projecting means further comprises an image changer for changing the image projected by said projector.

17. A shooting game apparatus comprising:

a plurality of playing areas, each of said playing areas having a background scene;

a vehicle path provided through said playing areas; and a vehicle, said vehicle moving along said vehicle path so that at least one player riding on said vehicle plays a shooting game in each of said playing areas while the player views the background scene of each of said playing areas, said vehicle comprising a display device for displaying an image of a target to be shot in said background scene of each of said playing areas so that a scene in which said image is synthesized with said background scene is viewed by the player.

18. The shooting game apparatus as claimed in claim 17, further comprising a main control unit controlling movement of said vehicle and a wireless communication system located between said vehicle and said main control unit for providing communications between said vehicle and main control unit.

19. The shooting game apparatus as claimed in claim 17, wherein said display device comprises a display monitor and a virtual image forming system, said display monitor displaying said image, said virtual image forming system synthesizing said image with said background scene when said background scene is viewed through said virtual image forming system.

20. The shooting game apparatus as claimed in claim 19, wherein said virtual image forming system comprises a concave half mirror which forms a virtual image of said image displayed on said display monitor so that said virtual image is synthesized with said background scene.

21. The shooting game apparatus as claimed in claim 20, wherein said virtual image forming system further comprises a filter provided between said concave half mirror and the player.

22. The shooting game apparatus as claimed in claim 21, wherein said filter softens lights produced by said display monitor which are viewed by the player.

23. The shooting game apparatus as claimed in claim 19, wherein said virtual image forming system comprises a Fresnel lens and a half mirror which together form a virtual image of said image displayed on said display monitor so that said virtual image is synthesized with said background scene.

24. The shooting game apparatus as claimed in claim 23, wherein said virtual image forming system further comprises a filter provided between said half mirror and the player.

25. The shooting game apparatus as claimed in claim 24, wherein said filter softens lights produced by said display monitor which are viewed by the player.

26. The shooting game apparatus as claimed in claim 17, wherein said display means further comprises an image changer for changing the image displayed by said display device.

27. The shooting game apparatus as claimed in claim 26, wherein said image changer changes image which are displayed in one of said playing areas.

* * * * *